United States Patent [19]

Ligh

[11] 3,948,163

[45] Apr. 6, 1976

[54] REFUSE COMPACTOR

[75] Inventor: David R. Ligh, Madison, N.J.

[73] Assignee: Piezo Engineering Company, Madison, N.J.

[22] Filed: Aug. 21, 1974

[21] Appl. No.: 499,426

Related U.S. Application Data

[63] Continuation-in-part of Ser. No. 289,235, Sept. 15, 1972, abandoned.

[52] U.S. Cl. ..... 100/53; 100/98 R; 100/127; 100/215; 100/218; 100/250; 100/269 R

[51] Int. Cl.[2] ..... B30B 15/16

[58] Field of Search..... 100/53, 215, 250, 269 R, 100/98 R, 127, 229 A, 218; 53/124 E; 141/73, 313, 316, 390

[56] References Cited

UNITED STATES PATENTS

| | | | |
|---|---|---|---|
| 1,182,369 | 5/1916 | Haniquet | 100/250 X |
| 1,969,862 | 8/1934 | Stilwell | 100/250 |
| 3,229,622 | 1/1966 | French et al. | 100/98 R X |
| 3,481,268 | 12/1969 | Price et al. | 100/127 X |
| 3,527,160 | 9/1970 | Vollmer | 100/250 X |
| 3,541,949 | 11/1970 | Clar | 100/229 A X |
| 3,604,345 | 9/1971 | Boje | 100/98 R X |
| 3,638,561 | 2/1972 | Price et al. | 100/250 X |
| 3,747,519 | 7/1973 | Capps et al. | 100/250 X |

FOREIGN PATENTS OR APPLICATIONS

| | | | |
|---|---|---|---|
| 333,004 | 2/1921 | Germany | 100/250 |

*Primary Examiner*—Billy J. Wilhite
*Attorney, Agent, or Firm*—Michael J. Striker

[57] ABSTRACT

A horizontally oriented tubular housing is provided at one open end in its circumferential wall with a cut-out at the upper side of the housing, which cut-out resembles a segment of the tubular housing. A ram is reciprocable in the housing axially thereof and a door is mounted at the open end and pivotable about arms located at opposite lateral sides of the housing, to and from a closure position overlying the open end. The door has a plate-shaped first portion a surface of which faces the open end when the door is in closure position and which carries on this surface rigid therewith another portion resembling a segment of the tubular housing so dimensioned as to fit into and close the cut-out of the circumferential wall of the tubular housing when the door is in its closure position.

17 Claims, 14 Drawing Figures

REFUSE COMPACTOR

CROSS-REFERENCE

This is a continuation-in-part of my application Ser. No. 289,235, filed on Sept. 15, 1972 and now abandoned.

BACKGROUND OF THE INVENTION

The present invention relates to a refuse compactor, and more particularly to a compactor for compacting of wet and/or dry refuse.

Refuse compactors are by now already well known. Generally speaking they have a housing in which a ram is reciprocated by hydraulic means, engaging a load of refuse placed into the housing and pushing it against a rigid surface so that the refuse is compressed and compacted between this surface and the ram which latter is thereupon retracted to permit removal of the compacted refuse. Generally speaking it is desirable in such compactors that the compacting of the refuse by the ram be against a door, so that upon completing of the compaction it is merely necessary to open the door to gain ready access to the compacted package so as to permit its removal. Evidently, the door must be structurally strong because the refuse is compacted against it under the pressure of the compacting ram or plunger.

It is known in the art to use hinged doors for this purpose, providing them with a lateral lock to retain them in closed position during compacting operation. There are two disadvantages to this, namely on the one hand, such doors must usually be manually operated and on the other hand, they cannot be employed for automatic operation, that is for automatic opening and closing. Another type of door which has been considered in this art is the guillotine type but this also is cumbersome in operation, aside from the fact that it requires considerable space for movement between open and closed positions and is difficult to make and to control in its proper movements.

Accordingly, it is a general object of the present invention to provide an improved refuse compactor which does not have the disadvantages outlined above with respect to the prior art.

More particularly, it is an object of the present invention to provide such a refuse compactor in which the door against which the refuse is compacted need not be manually opened.

Another object of the invention is to provide such a refuse compactor in which the door requires an absolute minimum of space for movement between open and closed positions.

Still a further object of the invention is to provide such a refuse compactor which due to the particular construction and operation of its outlet door, is extremely well suited for automatic operation.

in pursuance of these objects and of others which will become apparent hereafter, one feature of the invention resides, briefly stated, in a refuse compactor comprising a horizontally oriented tubular housing having an open end and a circumferential wall which is provided at said open end at the upper side of the housing with a cut-out resembling a segment of the tubular housing. An inlet is provided for refuse to be compacted, and compacting exerts pressure upon the refuse in the housing in direction axially towards the open end of the latter. According to the invention there is provided a door, mounted at the open end and pivotable to and from a closure position overlying and closing the open end. This door comprises a plate-shaped first portion having a surface facing the open end when the door is in its closure position, and a second portion which projects from the surface at an upper region of the door, being rigid therewith and resembling a segment of the tubular housing which is so dimensioned as to fit in and close the cut-out of the housing when the door is in its closure position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
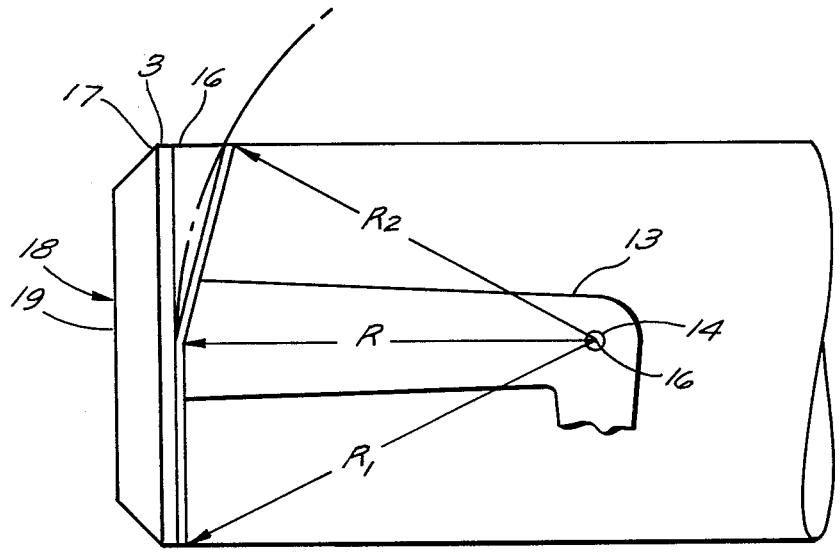
FIG. 1 is a fragmentary diagrammatic side view of an apparatus according to the present invention.

Discussing now the drawing in detail, and firstly FIG. 1, it will be seen that in that Figure, I have illustrated the principle on which my novel refuse compacting apparatus operates with respect to the door closing the open or discharge end of the housing. It will be seen that the housing is of substantially cylindrical shape, as illustrated diagrammatically, and that a door is provided in form of a plate-shaped element having at the side facing the open end of the cylindrical housing a portion welded to it which resembles a segment cut out of the cylindrical housing itself. The cylindrical housing is, in fact, provided with a segmental cut-out which is closed by the portion of the door when the latter is in the illustrated closure position. The door is pivoted to the housing by means of the arms (one shown) which are located at opposite lateral sides of the housing, being rigid with the door and being pivoted as illustrated.

In such an arrangement, with the housing in a horizontal position, the door can open freely if the dimension R1 is greater than the swinging radius R through which the door moves between open and closed position. R must also be greater than R2. An alternate solution is for R2 to be smaller than R1 and R.

Figure 2:
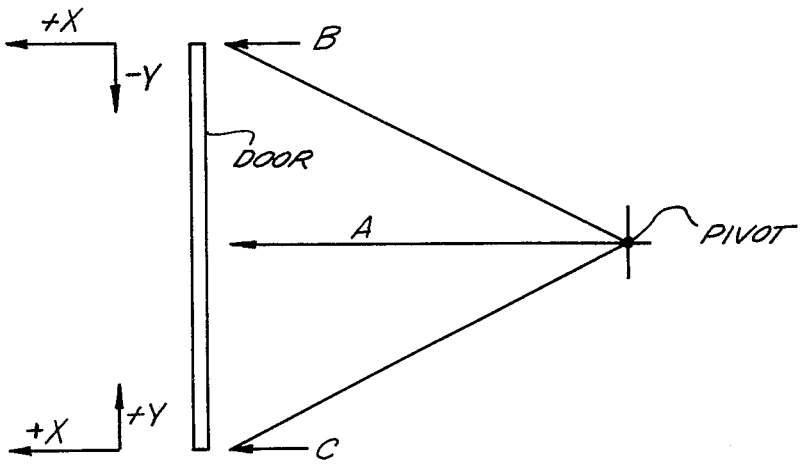
FIG. 2 is a force diagram applicable to the apparatus shown in FIG. 1 as well as to the more detailed views in the following Figures.

FIG. 2 shows a force diagram of the forces acting upon the door. The hinge point at which the arms are pivoted to the housing is illustrated, and it will be seen that when a compression is applied to refuse in the housing, urging the refuse against the door which is in closure position, normally there is a uniform force acting upon the housing represented by the forces A, B and C. Under these circumstances no lifting force acts upon the door and the latter remains stationary with all forces converging on the pivot point where the arms are pivoted to the housing.

Assuming, however, that a solid object, such as a rock, is in the refuse being compacted and if full pressure is applied at A, then force acts upon the door in only one direction and the door remains stationary. If, however, the object is so located within the refuse charge that the force acting upon the door acts at B, there are now actually two components of force acting upon the door, namely the force $+x$ and the force $-y$. Evidently, the $-y$ force tends to push the door downwardly and there is no movement of the door.

If, finally, the object in the refuse mix is so located that the force acts on the door at point C, the two force components now acting upon the door are the components $+x$ and $+y$, with the force $+y$ tending to lift the door upwardly. If the door is allowed to open freely, it will move upwardly until the force components equalize. To overcome this tendency of the door to move upwardly under such circumstances, I provide a cylinder and piston unit acting upon the door and counteracting this tendency, as I will explain subsequently.

The concept behind the mounting and operation of the door in my novel refuse compactor will now be understood.

Figure 3:
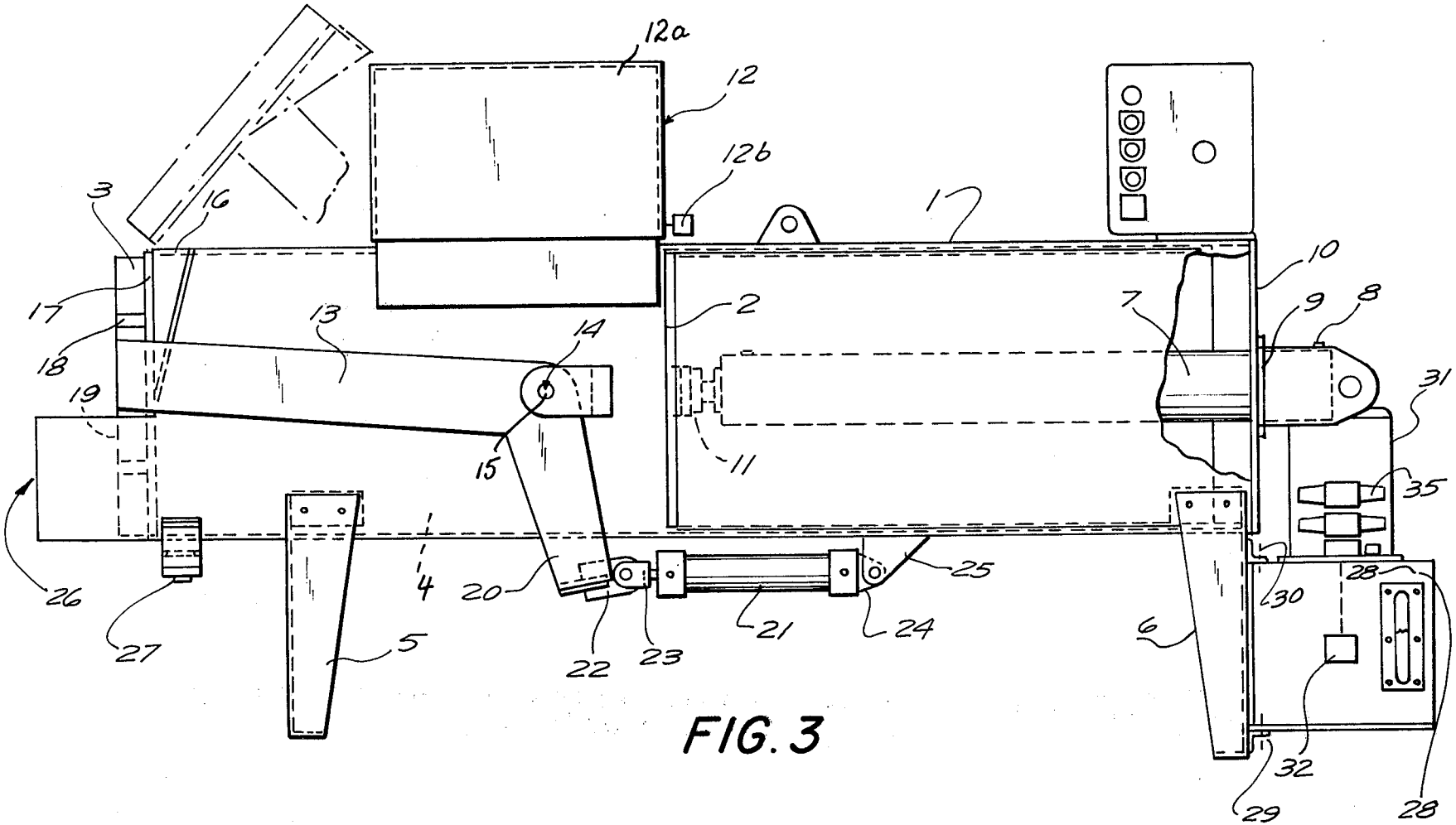
FIG. 3 is a side-elevational view of the apparatus shown in FIG. 1, illustrating the components in detail.
Figure 4:
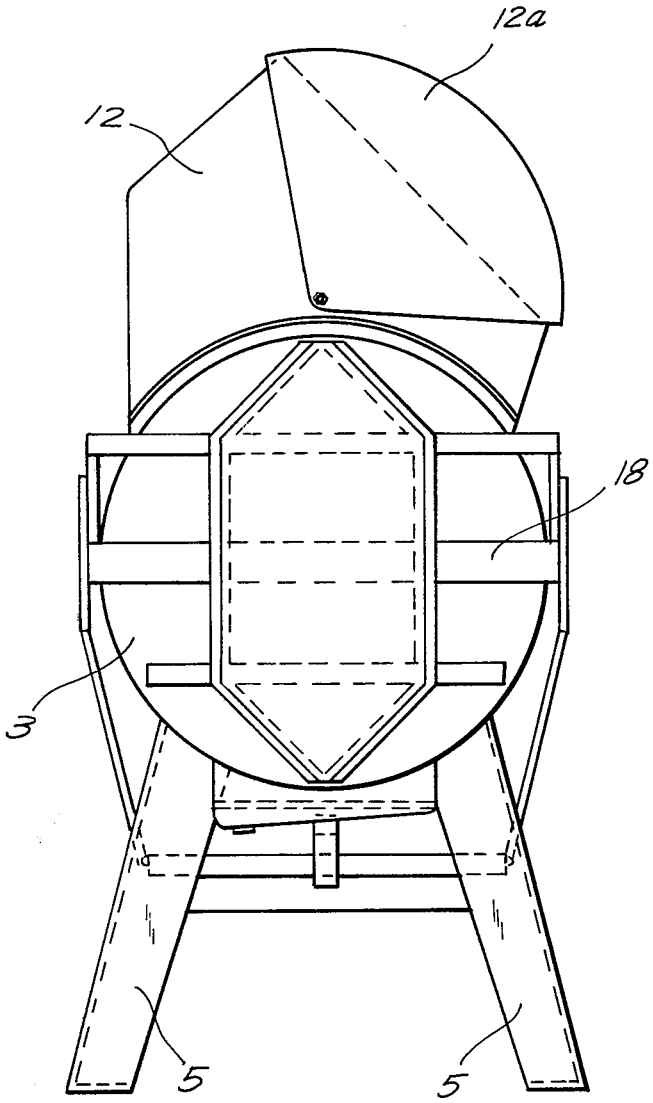
FIG. 4 is an end-elevational view of FIG. 3 looking towards the right in that Figure.
Figure 5:
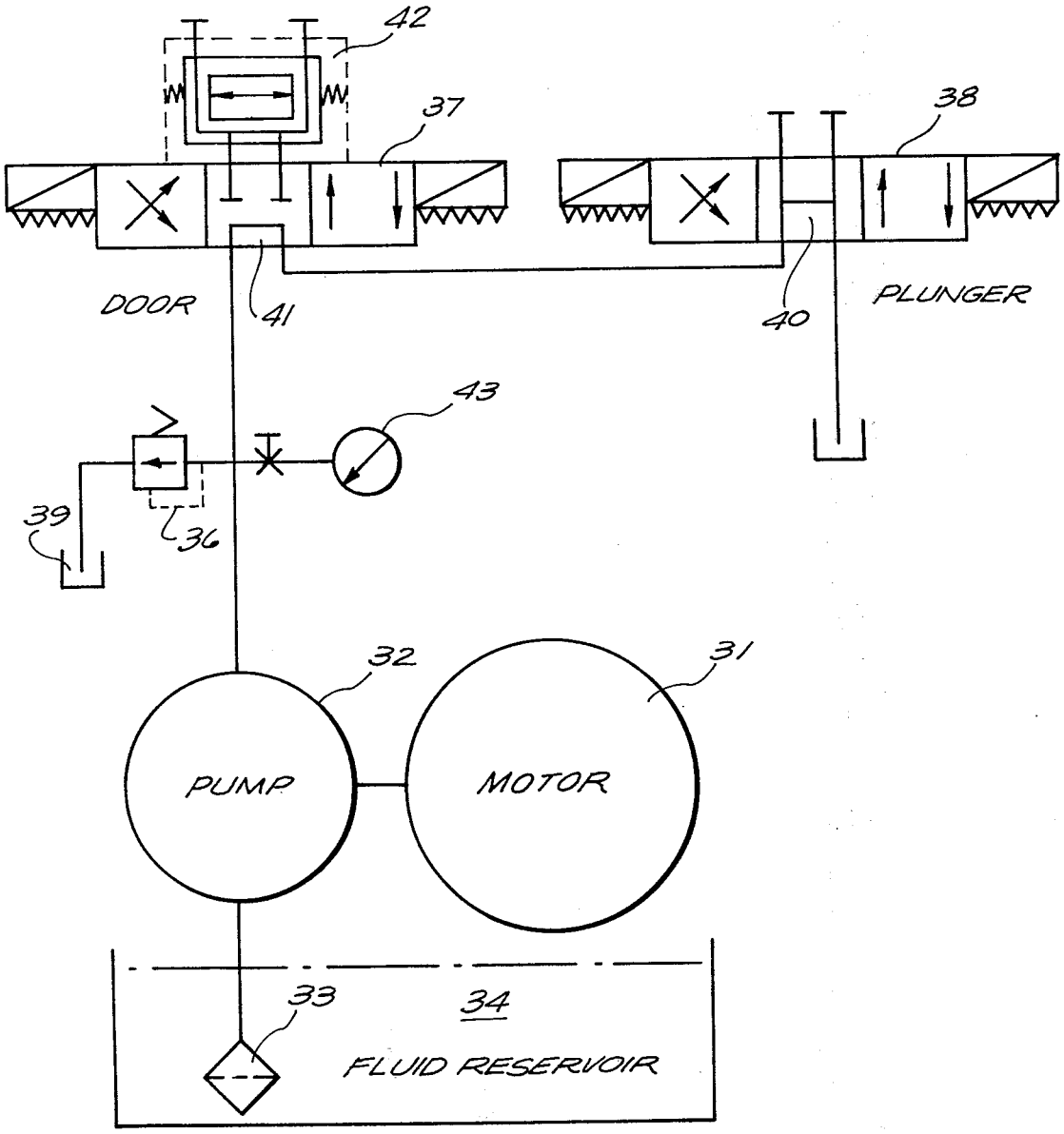
FIG. 5 is a diagram of the hydraulic circuit of the apparatus in FIGS. 1 – 4.

Moving now to a description of a specific embodiment, namely that illustrated in FIGS. 3 – 5, it will be seen that reference numeral 1 identifies a housing which in the illustrated embodiment is cylindrical and of circular cross-section but which could also be of polygonal cross-section if desired. The housing has a substantially horizontal orientation and a ram or plunger 2 is located within it for reciprocatory movement in axial direction of the housing. Reference numeral 3 identifies my novel door and reference numeral 4 the compacting chamber in the interior of the housing wherein refuse is to be compacted. The housing is mounted on legs 5 and 6, or on pairs of such legs. Reference numeral 7 identifies a power cylinder acting upon the plunger 2 and reference numeral 8 designates one end portion of the cylinder 7, with a flange 9 being provided.

Reference numeral 10 designates the right-hand end of the housing to which the flange 9 is securely connected. A swivel joint 11 connects the cylinder 7 with the plunger 2. It will be appreciated that when the cylinder 7 is energized, it will move the plunger 2 towards the left to compact refuse in the chamber 4 and subsequently it will again withdraw the plunger 2 towards the right.

A loading hopper 12 is provided on the housing 1 whose circumferential wall for this purpose is provided with a cut-out. The door **12*a* can close this hopper and a safety switch 12*b*** is provided which in known manner is associated with the power requirement of the apparatus to disable operation of the same when the door is opened to avoid the possibility that the plunger might move towards the left or towards the right when the door is open and might cause injury to an operator or somebody who is unauthorized.

Returning now to the door 3, it will be seen that the latter is mounted for pivotal movement about the pivot axis 14 by two arms 13 located at opposite lateral sides of the housing and being rigidly connected with the door 3. Pivots 15 secure the arms 13 to the housing, and define with one another pivot axis 14. The door has a vertical plate one side of which faces the open end of the housing when the door is in closure position as illustrated in solid lines, whereas its open position is illustrated in FIG. 3 in phantom lines. Secured to the surface or side of the plate 17 which faces the open end of the housing is a portion 16, for instance by welding, which portion resembles a cylindrical segment cut from the housing 1. The latter is, in fact, provided with such a cut-out at the upper side of its open end, as clearly evident in FIG. 3, and the segment 16 will enter into and close this cut-out in the closure position of the door 3. This is also clearly visible in FIG. 3. The door 3 is provided with reinforcing bars 18 and with a cover plate 19. The free ends of the arms 13 are connected with the bars 18, but at a substantial distance (2 inches or more) from the side of the housing 1. This is a safety feature to guard against injury in the event an operator should inadvertently place his hand or arm between the housing and one of the arms 13, which would cause the hand or arm to be crushed were to door 3 thereupon to move to open or closed position.

An arcuately curved linkage bar 20 extends beneath the housing 1 and connects the arms 13 with a single door-lift cylinder 21 that is mounted to the housing, brackets 22 being provided for connecting these bars 20 with a clevis unit 23 provided on the piston rod of the cylinder. At the opposite end the cylinder is provided with a clevis bracket 25 connecting with the cylinder at 24. The use of a single centrally located cylinder, acting upon the single arcuate bar or bracket 20, assures that uniform stresses are transmitted to both of the arms 13, thereby avoiding one-sided stressing that would result from the use of a single cylinder acting upon only one arm 13 while the other arm would have no cylinder, or from two cylinders which would each act upon one of the arms but non-uniformly in the absence of expensive synchronizing equipment.

Reference numeral 26 designates a spout or outlet, particularly for liquids which might be expelled from the refuse, and 27 designates a drain unit from which liquids may be drained for evacuation from the interior of the chamber 4.

A hydraulic power unit 28 is provided, being secured by mounting brackets 29 and 30 to the housing. An electric motor 31 drives a rotary gear pump 32, see FIG. 5, to withdraw hydraulic fluid from the reservoir 34 through a line communicating with the pump. Reference numeral 33 designates a screen provided at the intake of the line to assure that no clogging particles can enter the pump 32.

Reference numeral 35 designates a valve block which is electrically operated, that is in form of solenoid valves, and reference numeral 36 designates a relief valve, with reference numerals 37 and 38 designating four-way solenoid valves. 39 is a fluid reservoir. The position of valve 38 assumed in one operational condition of the same is designated with reference numeral 40, and reference numeral 41 also designates a position which can be assumed by the valve 37. Reference numeral 42 is a relief valve and reference numeral 43 designates a psi gauge, that is a gauge showing the pressure in pounds per square inches.

The cover plate 19 keeps the refuse, after it has been compacted and is ejected, from becoming lodged in the reinforcing bars of the door 3. The various conduits for the hydraulic circuit and the electrical connection between the safety switch 12*b* and the motor 31, have been omitted as not being important for an understanding of the invention and being conventional per se.

When the motor is energized and the control valve (to be discussed subsequently) is operated, hydraulic fluid pressure is generated in the system and the plunger 2 then moves towards the left or the right, depending upon the valve setting. It should be noted that the plunger 2 has a skirt extending towards the right, that is away from the door 3. This skirt, which is illustrated in FIG. 3, as being cylindrical, serves to close the opening of the inlet hopper 12, so that no refuse can fall into the housing 1 behind (to the right of) the plunger 2 while the same moves toward the left. Also, the skirt prevents the plunger 2 from tilting in the event of uneven local distribution in chamber 4.

At the end of the compacting stroke the plunger 2 is retracted towards the right and door 3 can now be hinged up or pivoted to the phantom line position shown in FIG. 3, to permit the removal of the compacted refuse. The hopper 12 may be maintained filled so that a new charge of refuse can be admitted into the housing 1 again when desired or necessary.

As far as the hydraulic system is concerned, it will be noted that the oil supplied from the reservoir 34 is fed into the valve part 35 which may be mounted on the cover of the reservoir. A relief valve limits the maximum pressure developed in the system and overpressure fluid is bled off. The four-way solenoid valves 37 and 38 control the direction of flow to the actuator cylinder as shown, and when the cylinder is not in operation, the system is unloaded and excessive heating of the hydraulic coil is avoided.

The valve 38 controls the cylinder actuating the pluner 2 and valve 37 controls the door cylinder 21. In the center position 40 of the valve 38, the valve ports are not blocked, and thereby the pressure on the plunger isrelieved, permitting the door 3 to open freely to the phantom-line position in FIG. 3. When the valve 37 is in its center position 41 both of its ports are blocked to prevent movement of the door. However, a cross-over relief valve 42 allows only a preset pressure to build up in the event the door should be forced open by the compaction pressure. This is a safeguard against rupture of the hydraulic conduits in the event the force on the door should be greater than could be withstood by the conduits associated with the cylinder 21.

The cylinder 7 may have a five-inch diameter piston to provide maximum force in the forward direction of the plunger 2. The piston rod can be chosen to be rather large, reducing the net area of the piston for the reverse direction so that the stroke time for retraction can be cut in half. A minimum of force is then required for the return stroke. The door can be opened by the operation of the cylinder 21 which acts via its piston rod upon the bars 20 which are fast with the arms 13 to swing the door to the phantom line position in FIG. 3. To close the door the piston rod of the cylinders 21 is retracted. Plunger 2 may be so positioned that it will actually eject the compacted refuse, for which purpose it is merely necessary to stop compaction when the desired degree of compaction is achieved, open the door 3, backing off the plunger 2 if necessary, and again advancing the plunger 2 so that it will push the compacted refuse out the open end of the housing 1 whereupon the plunger 2 is then again retracted to its starting position at the right hand side of the housing 1.

I have found that it is not necessary that the door should seal the chamber 4 absolutely tightly; a small gap may remain without resulting in disadvantageous consequences, especially as all expressed liquid is drained through the bottom drain 27 so that no escape of liquid through such a gap need be feared.

Figure 6:
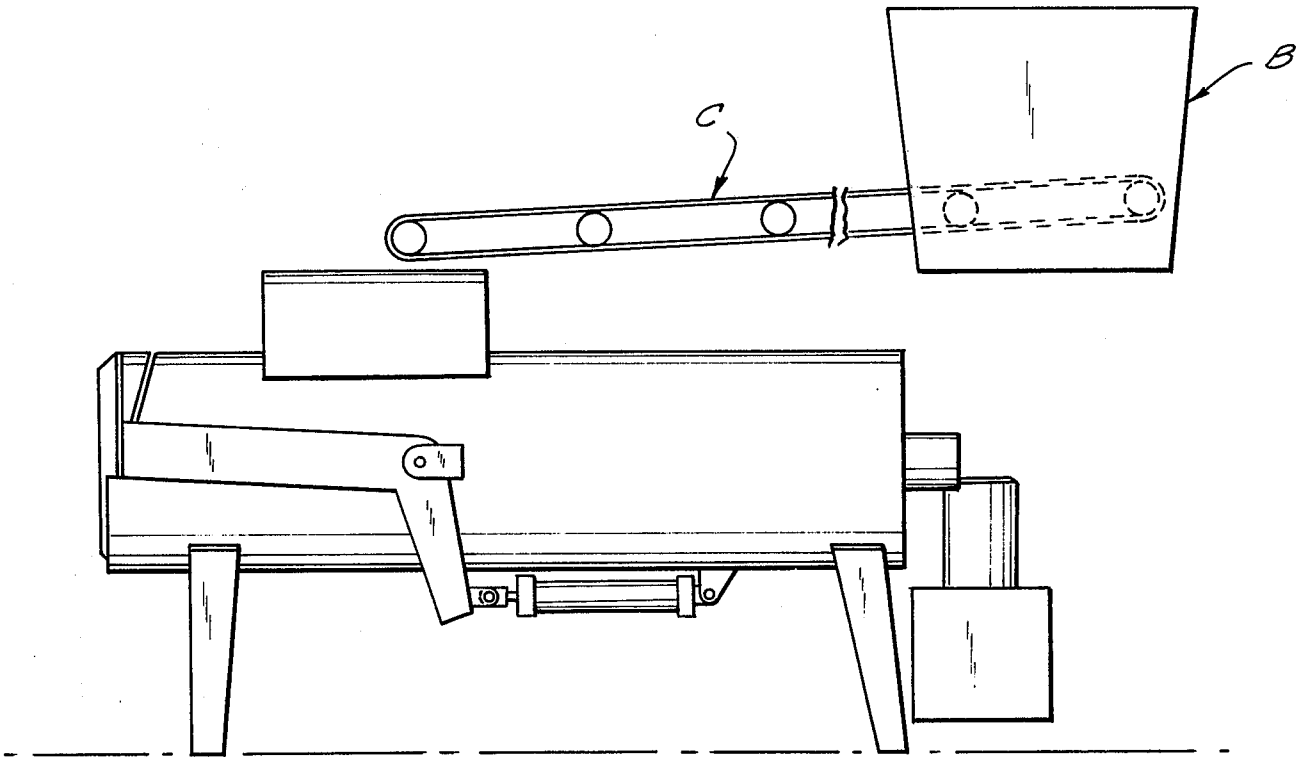
FIG. 6 is a diagrammatic view illustrating a further embodiment of the invention.

In the embodiment of FIG. 6 I have illustrated diagrammatically an apparatus such as is shown in FIGS. 3 – 5, but slightly modified for automatic operation. It will be seen that here a conveyor C may be provided, the downstream end of which feeds into the hopper 12, whereas the upstream end is located within a suitable bin B. Such an arrangement could for instance be used to advantage in an apartment house, where a refuse shaft could discharge into the bin B from where the refuse would be carried by the conveyor C into the hopper 12. The operation would then be automatic, the hopper 12 being constantly fed with refuse to be compacted, and with a new charge of refuse beingadmitted every time the plunger is stopped.

Figure 7:
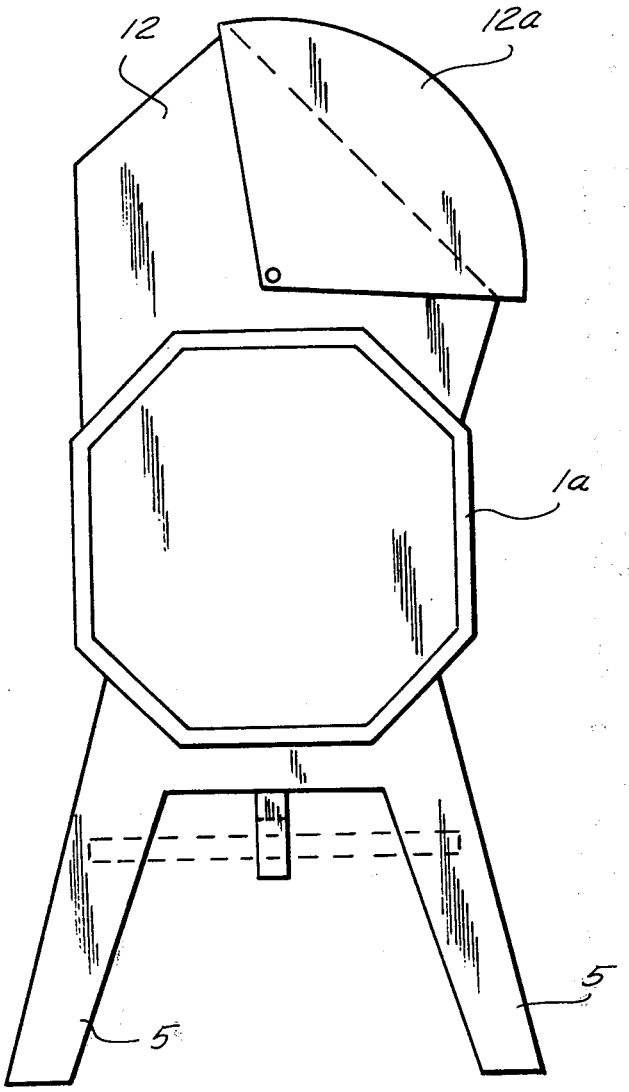
FIG. 7 is another diagrammatic illustration, in an end view, showing still an additional embodiment.

FIG. 7 shows in a diagrammatic end view, in which all other parts have been omitted, that the housing 1*a* could also be of polygonal cross-section.

Figure 8:
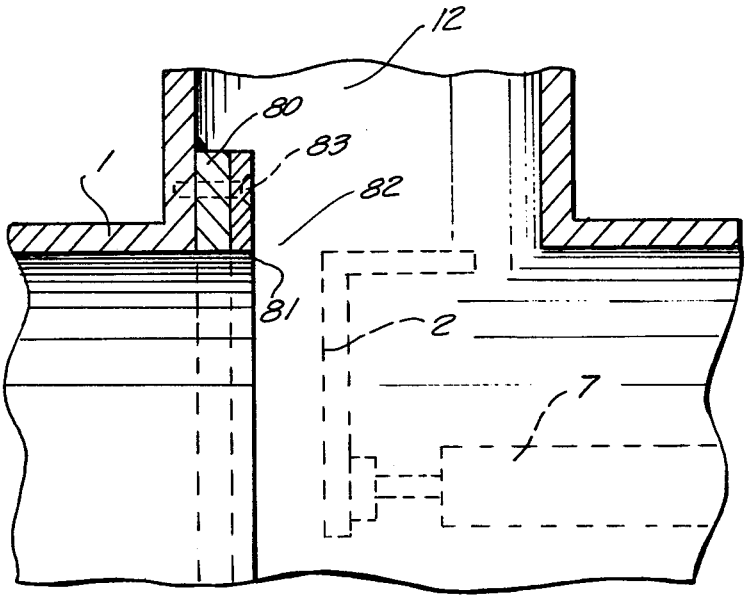
FIG. 8 is an enlarged fragmentary perspective view, illustrative a further embodiment.

FIG. 8 shows that I may use a cutting-off arrangement in my compactor, for cutting off the material in the hopper 12 from that which is located in the compacting chamber 4. For this purpose, I provide the downstream (in direction of compacting) edge that bounds the opening where the hopper 12 communicates with the chamber 4, with an arcuate reinforcing bar 80 that extends along this entire edge and is welded to the housing and/or the hopper 12. Secured to this reinforcing bar 80 with screws 83 is a similarly arcuate cutting blade 81 whose cutting edge faces opposite the compacting direction. The blade 81 may be of hardened steel and cuts off the material in chamber 4 from the material in hopper 12, when the plunger 2 moves towards the left (i.e. in compacting direction). This eliminates undue stresses due to excess material being squeezed into the chamber 4 and extends the useful life of the compactor.

Figure 9:
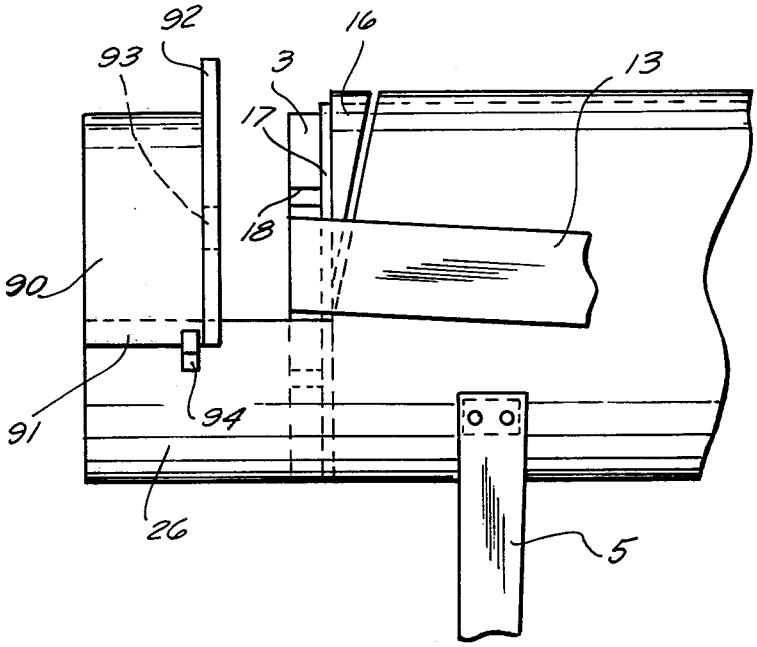
FIG. 9 is a side-elevational view, showing a detail of a further embodiment.

FIG. 9 shows that my compactor may be provided with a modified bagging spout. The spout 26 is present as before. However, in addition I provide a part-cylindrical upper spout portion 90 having an inner radius greater than that of the spout 26 and being hinged to one edge (not visible) of the latter for tilting movement about a horizontal axis (analogous to the movement of hopper door 12*a*). A catch 94 of any desired type holds the portion 90 normally in closed position, with a portion 91 of spout 90 overlapping the other edge (i.e. the visible one) of spout 26. The portion 90 is provided with a radially projecting guard flange 92 which serves as an abutment for the open end of a bag that is to be slipped over elements 26, 90, and also as a safety aid to prevent the user from placing his hands in the vicinity of the door 3.

When the material in chamber 4 is compacted, the plunger 2 is slightly backed off and door 3 is opened. Thereupon, plunger 2 is moved further forwardly so that it expels the compacted material through the elements 26, 90 into the aforementioned bag which can then be tied off. When the material leaves the chamber 4 it tends to expand somewhat; it is for this reason that the radius of portion 90 is somewhat (i.e. on the order of 1 – 2 inches) larger than that of the spout 26, so as to prevent jamming of the material in the elements 26, 90 when such expansion takes place.

Figure 10:
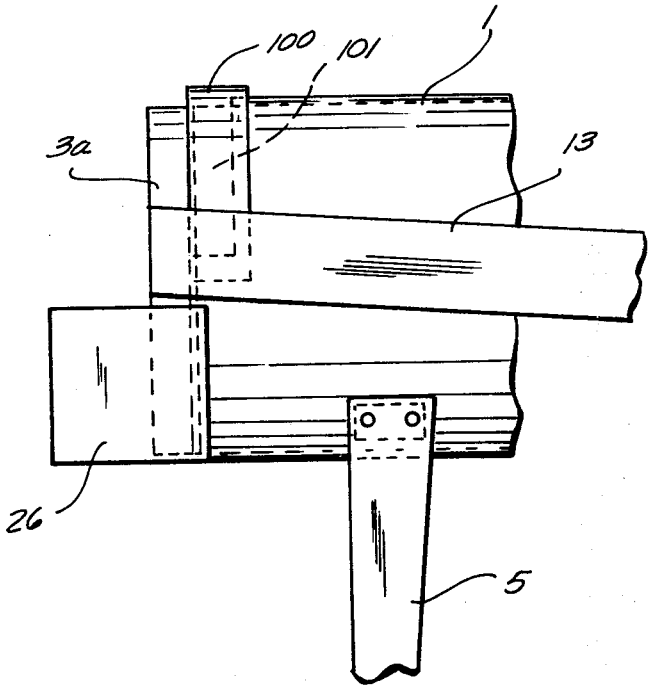
FIG. 10 is also a side-elevational view, but showing a detail of yet another embodiment.

Consequently, FIG. 10 shows that the end of housing 1 at which the door is located, can also be constructed differently from the showing in FIG. 3. In this embodiment, which in all other respects corresponds to FIG. 3, the end of the housing is formed with a part-circumferential cut-out 101 of rectangular cross-section. The door 3*a* has welded or otherwise secured to its upper periphery an arcuate strip 100 which, when the door is closed, overlies the cut-out 101 and partly overlaps the housing 1 as shown, thus closing but not sealing the open end of chamber 4.

Figure 11:
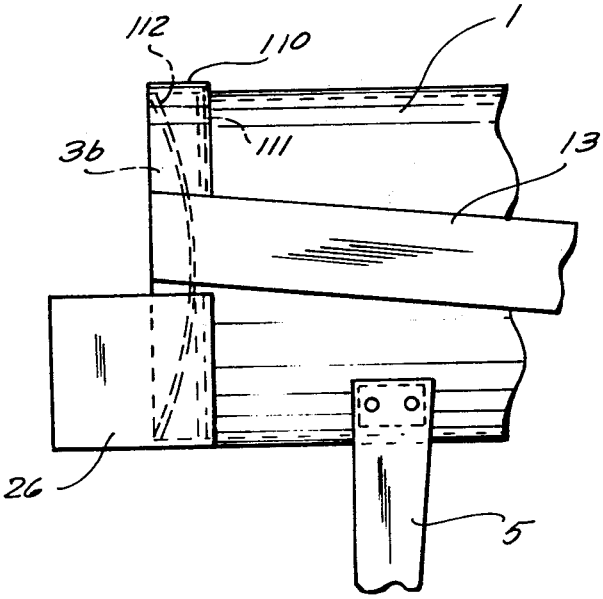
FIG. 11 is a view analogous to FIG. 10, illustrating a detail of a different embodiment.
Figure 11A:
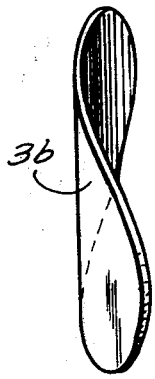
FIG. 11a is a perspective view of the door in FIG. 11, with parts omitted for the sake of better illustration.

The embodiment in FIGS. 11 and 11a is another modification of the housing cut-out and the door. The door 3*b* here has a part-cylindrical shape, i.e., a shape resembling a portion of a cylinder having an axis normal to the plane of FIG. 11. At its upper periphery the door 3*b* has an arcuate strip 110 which bridges the gap that would otherwise exist between the housing edge and the curved surface 112 of the door 3*b*. The housing edge is somewhat recessed at 111 to form sufficient clearance for movement of the door between open and closed positions. As FIG. 11*a* shows, the concave side of the door faces inwardly of the chamber 4.

Figure 12:
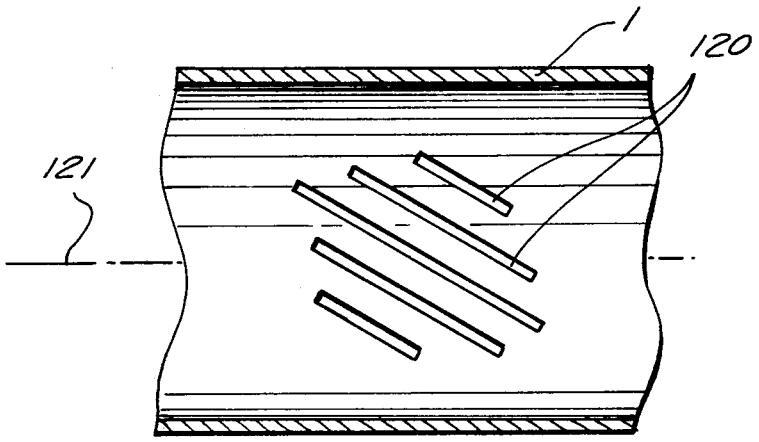
FIG. 12 is a fragmentary sectional view, showing a detail of a drain used in my novel compactor.
Figure 13:
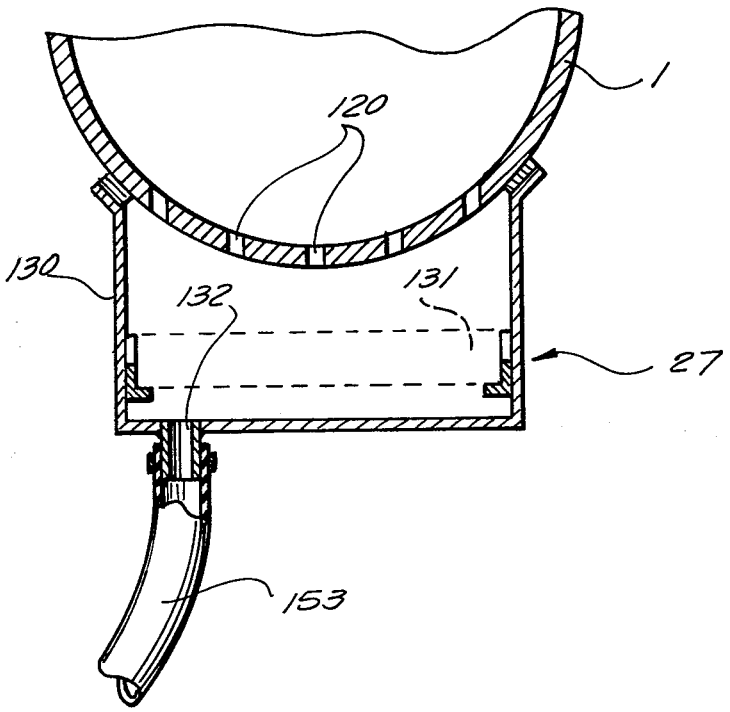
FIG. 13 is a fragmentary vertical section, showing details of the drain unit into which the drain of FIG. 12 discharges.

FIGS. 12 and 13, finally, show details of the drain unit 27 (see FIG. 3). The bottom portion of the housing 1 will be seen to be provided (in the region of the door, which is not visible in FIGS. 12 and 13) with drain slots 120. These extend at an angle to the longitudinal axis 121 of the housing 120 to assure that no liquid can run out of the housing through the open door, by passing between the slots.

Beneath the housing 1 is mounted (by welding or the like) a casing 130 into which the slots 120 discharge. Located in the casing, which may have a (not-illustrated) access door, is an inclined drain pan 131 which is configurated as a screen basket which screens out particulate material. The liquid runs off into the casing 130 and from there into the outlet 132 which may be connected with a floor drain leading to a sewer, or with a hose 153 leading to the floor drain or sewer.

It will be understood that each of the elements described above, or two or more together, may also find a useful application in other types of constructions differing from the types described above.

While the invention has been illustrated and described as embodied in a refuse compactor, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a refuse compactor, a combination comprising a horizontally oriented tubular housing having an open end and a circumferential wall bounding a compacting chamber; an inlet for admitting refuse to be compacted into said chamber; compacting means for exerting pressure upon refuse in said housing in direction axially towards said open end; a door mounted at said open end and being pivotable to and from a closure position overlying and closing the same, said door comprising a plate-shaped portion having a surface facing said open end when said door is in said closure position; a pair of elongated arms located at opposite lateral sides of said housing and each having an elongated first end portion having one end rigid with said door and an elongated second end portion extending from another end of said first end portion at an angle to the latter and forming a juncture with said other end, said second end portions each having a free end; a connecting portion extending transversely of the axis of said housing and connecting said free ends of said second end portions with one another; pivot means extending through said junctures and pivotably connecting said arms to said housing at locations axially spaced from said open end; and a single fluid-operated cylinder and piston means connected with said connecting portion midway between said junctures for effecting pivoting of said arms about said pivot means.

2. A combination as defined in claim 1; and further comprising reinforcing portions provided on said door for reinforcing the same.

3. A combination as defined in claim 1, wherein said circumferential wall is provided at said open end at the upper side of said housing with a cut-out resembling a segment of the tubular housing; and wherein said door includes a further portion projecting from said surface at an upper region of said door rigid therewith and resembling a segment of the tubular housing so dimensioned as to fit in and close said cut-out when said door is in said closure position.

4. A combination as defined in claim 1; wherein said door is mounted on said housing in such a manner that the door remains in said closure position during exertion of compacting pressure upon refuse in said housing and transmission of such pressure to said door.

5. A combination as defined in claim 1, said door being engaged by and receiving pressure in direction axially of said housing from the compacted refuse; said compacting means comprising means for relieving such pressure on said door for facilitating pivoting of the same from said closure position.

6. A combination as defined in claim 1; and further comprising drain means communicating the interior with the exterior of said housing for draining off of liquids expressed from the refuse.

7. A combination as defined in claim 1 said inlet being provided in said circumferential wall intermediate said open end and the other end of said housing, and said compacting means comprising a plunger travelling at least partly across said inlet during movement toward said open end; and further comprising a tubular skirt provided on the rear side of said plunger which faces away from said open end for preventing refuse from falling into said housing at said rear side when said plunger travels across said inlet.

8. A combination as defined in claim 1, said inlet being provided in said circumferential wall intermediate said open end and the other end of said housing and being bounded by an edge region having an edge portion located at a side of said inlet which is closest to said open end; said compacting means comprising a plunger which travels across said inlet and said edge portion during movement toward said open end; and further comprising a cutting blade mounted on said edge portion and having a cutting edge so oriented as to sever the refuse in said chamber from the refuse still in said inlet, in response to movement of said plunger toward said open end.

9. A combination as defined in claim 1, said inlet being provided in said circumferential wall intermediate said open end and the other end of said housing, and said plunger travelling at least partly across said inlet during movement toward said open end; and further comprising means for preventing refuse from falling into said housing at the side of the plunger facing away from said open end, when said plunger travels across said inlet.

10. A combination as defined in claim 1; and further comprising pressure-relief means operatively associated with said cylinder and piston means for relieving pressure acting upon the same via said door when the latter is subjected to pressure by the refuse being compacted.

11. A combination as defined in claim 1, wherein said pressure-relief means comprises a hydraulic circuit.

12. A combination as defined in claim 1, wherein said housing is cylindrical.

13. A combination as defined in claim 1, wherein said housing is of polygonal cross-section.

14. A combination as defined in claim 1, wherein said surface of said portion of said door is convexly curved in direction of said open end to resemble a part of the surface of a cylinder having a horizontal axis normal to the elongation of said tubular housing.

15. In a refuse compactor, a combination comprising a horizontally oriented tubular housing having an open end and a circumferential wall bounding a compacting chamber, said circumferential wall being provided at said open end and at the upper side of said housing with an arcuate part-circumferential cut-out of rectangular cross-section; an inlet for admitting refuse to be compacted into said chamber; compacting means for exerting pressure upon refuse in said housing in direction axially towards said open end; a door mounted at said open end and being pivotable to and from a closure position overlying and closing the same, said door comprising a plate-shaped portion having a surface facing said open end when said door is in said closure position, and a further portion projecting from said surface at an upper region of said door rigid therewith and having a part-cylindrical configuration, said further portion overlying said cut-out and partly overlapping said circumferential wall when said door is in said closure position; a pair of elongated arms located at opposite lateral sides of said housing and each having a first end portion rigid with said door and a second end portion, and a connecting portion extending transversely of the axis of said housing and connecting said second end portions with one another; pivot means pivotably connecting said second end portions to said housing at locations axially spaced from said open end; and a single fluid-operated cylinder and piston means connected with said connecting portion midway between said arms for effecting pivoting of said arms about said pivot means.

16. In a refuse compactor, a combination comprising a horizontally oriented tubular housing having an open end and a circumferential wall bounding a compacting chamber; an inlet for admitting refuse to be compacted into said chamber; compacting means for exerting pressure upon refuse in said housing in direction axially towards said open end; a door mounted at said open end and being pivotable to and from a closure position overlying and closing the same, said door comprising a plate-shaped portion having a surface facing said open end when said door is in said closure position; a pair of elongated arms located at opposite lateral sides of said housing and each having a first end portion rigid with said door and a second end portion, and a connecting portion extending transversely of the axis of said housing and connecting said second end portions with one another; pivot means pivotably connecting said second end portions to said housing at locations axially spaced from said open end; a single fluid-operated cylinder and piston means connected with said connecting portion midway between said arms for effecting pivoting of said arms about said pivot means; and drain means communicating the interior with the interior of said housing for draining off liquids expressed from said refuse, said drain means comprising a plurality of slots formed in a lower region of said circumferential wall in the vicinity of said door and being inclined transversely of the elongation of said housing, a casing mounted on said housing beneath said slots, a downwardly inclined drain pan in said casing, and a screen overlying said drain pan.

17. In a refuse compactor, a combination comprising a horizontally oriented tubular housing having an open end and a circumferential wall bounding a compacting chamber; an inlet for admitting refuse to be compacted into said chamber; compacting means for exerting pressure upon refuse in said housing in direction axially towards said open end; a door mounted at said open end and being pivotable to and from a closure position overlying and closing the same, said door comprising a plate-shaped portion having a surface facing said open end when said door is in said closure position; a pair of elongated arms located at opposite lateral sides of said housing and each having a first end portion rigid with said door and a second end portion, and a connecting portion extending transversely of the axis of said housing and connecting said second end portions with one another; pivot means pivotably connecting said second end portions to said housing at locations axially spaced from said open end; a single fluid-operated cylinder and piston means connected with said connecting portion midway between said arms for effecting pivoting of said arms about said pivot means; and a bagging spout projecting from said open end of said housing and including an upwardly open lower arcuate portion and a downwardly open upper arcuate portion hinged to said lower portion and defining with the same a cross-sectional area greater than that of said open end, and a radial flange extending from said upper arcuate portion for abutment of a bag slipped over said spout and for preventing a user from reaching to the vicinity of said door.

* * * * *